US008671692B2

(12) United States Patent
Burd et al.

(10) Patent No.: US 8,671,692 B2
(45) **Date of Patent: *Mar. 18, 2014**

(54) ANNULAR GAS TURBINE COMBUSTOR INCLUDING CONVERGING AND DIVERGING SEGMENTS

(75) Inventors: Steven W. Burd, Cheshire, CT (US); William Sowa, Simsbury, CT (US); Albert K. Cheung, East Hampton, CT (US); Stephen Karl Kramer, Cromwell, CT (US); Reid Dyer Curtis Smith, Amston, CT (US); James Hoke, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 138 days.

This patent is subject to a terminal disclaimer.

(21) Appl. No.: 13/251,586

(22) Filed: Oct. 3, 2011

(65) Prior Publication Data

US 2012/0017599 A1 Jan. 26, 2012

Related U.S. Application Data

(62) Division of application No. 11/252,104, filed on Oct. 17, 2005, now Pat. No. 8,028,528.

(51) Int. Cl.
*F02C 1/00* (2006.01)
*F02G 3/00* (2006.01)

(52) U.S. Cl.
USPC ..... 60/752; 60/753; 60/754; 60/755; 60/756; 60/757; 60/758; 60/759; 60/760; 60/39.17; 60/39.37; 60/269; 60/722; 60/732; 60/772

(58) Field of Classification Search
USPC ..... 60/752–760, 772, 39.37, 39.17, 269, 60/722, 732
See application file for complete search history.

(56) References Cited

U.S. PATENT DOCUMENTS

| | | | |
|---|---|---|---|
| 2,587,649 | A | 3/1952 | Pope |
| 3,095,694 | A | 7/1963 | Walter |
| 3,982,392 | A | 9/1976 | Crow |

(Continued)

FOREIGN PATENT DOCUMENTS

| | | |
|---|---|---|
| DE | 19631616 | 2/1998 |
| EP | 0544350 A1 | 6/1993 |

(Continued)

OTHER PUBLICATIONS

Extended European Search Report for EP06255344.1 mailed on May 28, 2010.

*Primary Examiner* — Gerald L Sung
*Assistant Examiner* — Craig Kim
(74) *Attorney, Agent, or Firm* — Carlson, Gaskey & Olds, P.C.

(57) ABSTRACT

A combustor assembly includes a convergent segment followed by a divergent segment to advantageously improve combustion. The combustor assembly includes a first segment beginning at a forward end that transitions to a second segment past a transition segment in a direction along a combustor axis toward an aft end. The reduction in cross-sectional area within the first segment provides desirable fuel and air mixing properties. The convergent first segment in combination with the divergent second segment decreases residence time of fuel-air mixture within the combustor chamber that decreases production of undesirable emissions from the combustor assembly.

14 Claims, 3 Drawing Sheets

(56) References Cited

U.S. PATENT DOCUMENTS

| | | | | | |
|---|---|---|---|---|---|
| 4,206,593 | A | | 6/1980 | Su et al. | |
| 4,244,178 | A | * | 1/1981 | Herman et al. | 60/754 |
| 4,260,367 | A | | 4/1981 | Markowski et al. | |
| 4,265,615 | A | * | 5/1981 | Lohmann et al. | 431/353 |
| 4,285,193 | A | | 8/1981 | Shaw et al. | |
| 4,420,929 | A | * | 12/1983 | Jorgensen et al. | 60/776 |
| 4,787,208 | A | * | 11/1988 | DeCorso | 60/723 |
| 4,819,438 | A | * | 4/1989 | Schultz | 60/730 |
| 4,984,429 | A | | 1/1991 | Waslo et al. | |
| 5,628,192 | A | * | 5/1997 | Hayes-Bradley et al. | 60/733 |
| 5,791,148 | A | | 8/1998 | Burrus | |
| 6,105,360 | A | * | 8/2000 | Willis | 60/777 |
| 8,028,528 | B2 | * | 10/2011 | Burd et al. | 60/752 |

FOREIGN PATENT DOCUMENTS

| | | |
|---|---|---|
| FR | 2694799 | 2/1994 |
| GB | 2278431 | 11/1994 |
| JP | 4139312 | 5/1992 |

* cited by examiner

ANNULAR GAS TURBINE COMBUSTOR INCLUDING CONVERGING AND DIVERGING SEGMENTS

CROSS REFERENCE TO RELATED APPLICATION

This application is a divisional of U.S. application Ser. No. 11/252,104 filed on Oct. 17, 2005 now U.S. Pat. No. 8,028,528.

BACKGROUND OF THE INVENTION

This invention is generally related to a geometric configuration of a combustor chamber. More particularly, this invention is related to an annular combustor chamber including a convergent segment and a divergent segment.

Conventional gas turbine engines include a compressor, combustor and a turbine. The combustor may be of several configurations including an annular combustion chamber that is symmetrical about an axis of the engine. The annular combustor includes a segment where fuel is mixed with high-pressure air and ignited. The combustion chamber is shaped to encourage complete burning of the fuel air mixture and to provide a desired flow of combustion gases through to the turbine.

Emissions that are generated by the gas turbine engine are a concern and consideration in the design and operation of a combustor. Undesirable emission performances are caused by the stoichiometry inefficient mixing of fuel and air both spatially and with time through the combustor volume. For this reason, combustors are designed to encourage highly efficient mixing of fuel and air and control the stoichiometry of the fuel-air mixture. Further, it is also desirable to exhaust combustion gases from the combustor in a well-mixed homogeneous manner.

Disadvantageously, mixing of air and fuel within a combustion chamber takes time, time that combusts the fuel-air mixture to high temperatures thereby causing production of undesirable emissions such as nitrous oxide, carbon monoxide, carbon dioxide, and other hydrocarbons as a result of incomplete combustion or locally-supported stoichiometry.

Accordingly, it is desirable to develop a combustor assembly that provides desired mixing of fuel and air and that reduces residence time within the combustor to reduce the production and emission of undesirable combustion by-products.

SUMMARY OF THE INVENTION

An example combustor assembly according to this invention includes a convergent segment followed by a divergent segment to advantageously improve combustion.

An example combustor assembly according to this invention includes a first segment, a transition segment and a second segment. The first segment begins at a forward end of the combustion assembly commonly referred to as the bulkhead and converges along an axial length toward the transition segment. The second segment diverges along its axial length in a direction away from the transition segment. The transition segment may have a definite axial length or may be substantially a plane defining a juncture between the first and second segments. All segments may include cooling means for the inner surfaces of the combustor chamber. Further, additional apertures proximate the transition segment may be included to support the combustion process.

The reduction in transverse span within the first segment provides desirable fuel and air mixing properties. The convergent configuration of the first segment in combination with the divergent second segment decreases residence time for the fuel air mixture within the combustor chamber. The decrease in residence time of the fuel-air mixture within the combustor chamber decreases undesirable emissions from the combustor assembly.

Another example combustor according to this invention includes a transition segment having an axial length. The transition segment includes a series of apertures for the introduction of air into the transition segment to aid in mixing and combustion of fuel. In another example combustor assembly, orientation of the outer wall and the inner wall in the transition segment are spaced apart a constant radial distance to provide better control of the introduction and processing of air and mixing volume of the fuel-air mixture that in turn results in desirable temperature and flow quality and distribution to the downstream turbine vane. Apertures may be provided proximate a substantially planar transition segment to aid in processing and mixing of fuel and air.

Accordingly, the convergent-divergent arrangement of a combustor assembly according to this invention provides design flexibility and fuel-air mixture control for reducing emissions without sacrificing other desirable elements of the combustor assembly design.

These and other features of the present invention can be best understood from the following specification and drawings, the following of which is a brief description.

DETAILED DESCRIPTION OF THE PREFERRED EMBODIMENT

Figure 1:
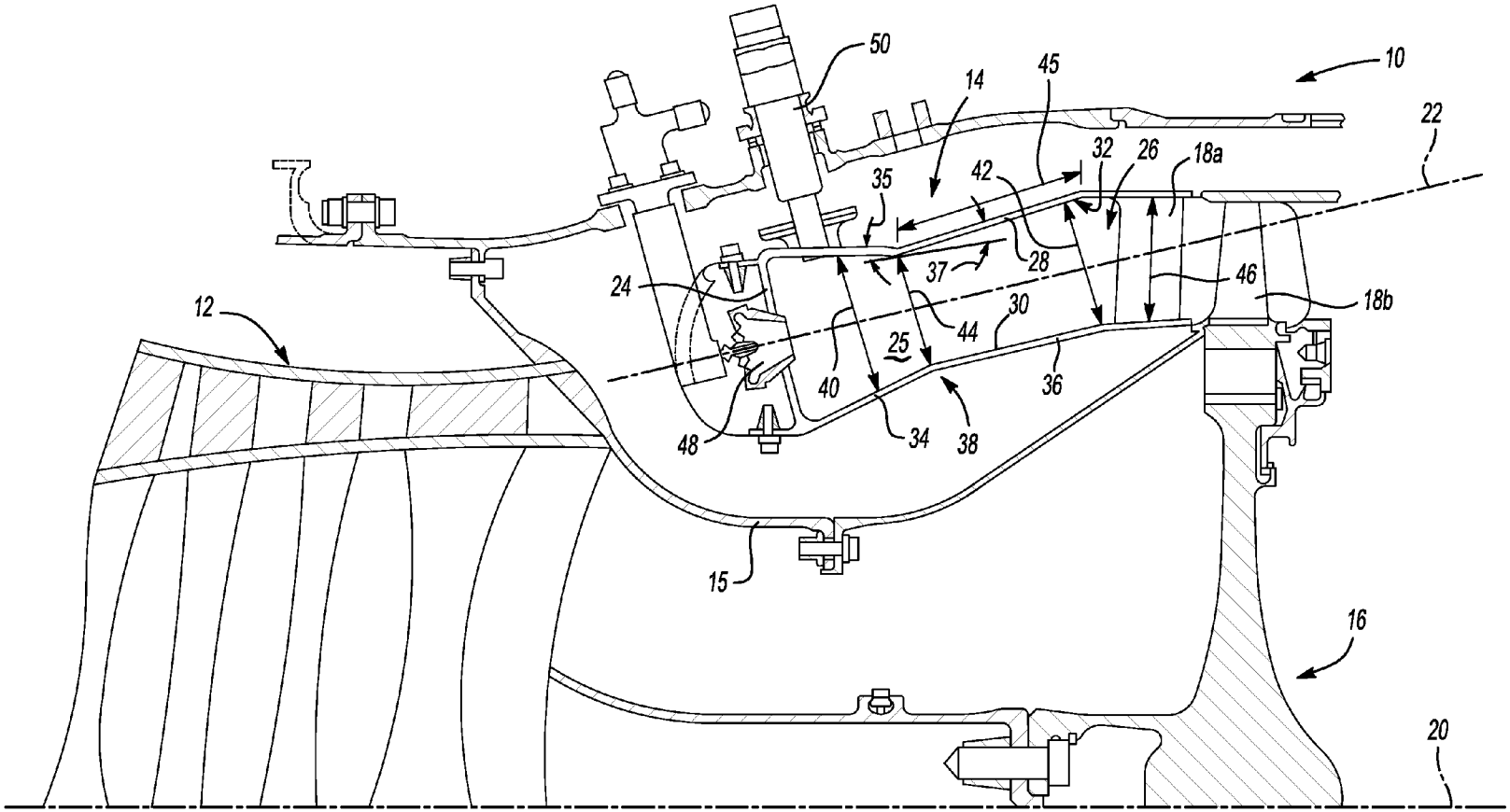
FIG. 1 is a cross-section of a gas turbine engine including an example combustor assembly according to this invention.

Referring to FIG. 1, a gas turbine engine 10 includes a fan (not shown) a compressor 12 (aft portion shown schematically), an annular combustor assembly 14 and a turbine assembly 16. The turbine assembly 16 includes a plurality of fixed turbine vanes 18A (only one shown for clarity) and rotatable turbine blades 18B that convert axial flow of combustion gases from the combustor assembly 14 into rotary motion that drives the compressor 12 and/or fan. The combustor assembly 14 is annular about the axis 20 such that the combustor assembly 14 includes a radial outer wall 28 and a radial inner wall 30. The combustor assembly 14 includes a forward end 24 where fuel and air are mixed and ignited and an aft end 26 where combustion gases exit the combustor assembly 14. The aft end 26 includes an opening that corresponds to an exit span 46 for the turbine vane 18A. The combustor assembly 14 is enveloped by a diffuser 15 that receives compressed air from the upstream compressor 12.

The combustor assembly 14 is divided into a first segment 34 beginning at the forward end 24 that transitions to a second segment 36 past a transition segment 38 in a direction along the combustor axis 22 towards the combustor exit 26. The first segment includes a fuel nozzle 48.

The first segment 34 converges beginning at the forward end 24 of the combustor moving aft along the combustor axis 22 toward the transition segment 38. The desired convergence is provided by angling the radially inner wall 30 and radially outer wall 28 to form an included angle 35 of between just a few degrees and 45 degrees relative to the axis 22. The angles of the inner and outer walls 30, 28 can be orientated at angles to the combustor axis 22 that differ in magnitude and sense. The convergent configuration of the first segment 34 includes a distance 40 between the outer wall 28 and the inner wall 30 transverse to the combustor axis 22 that decreases beginning at the forward end 24 in an axial direction toward the transition segment 38.

The second segment 36 begins at the transition segment 38 and diverges in a direction moving aft along the combustor axis 22 toward the aft end 26. The divergent second segment 36 is created by angling the radially inner wall 30 and radially outer wall 28 to form an included angle 37 of between 135 degrees and just under 180 degrees relative to axis 22. The divergent second segment 36 includes a distance 42 transverse to the combustor axis 22 that increases from the transition segment toward the aft end 26.

The decreasing distance 40 in the first segment 34 generally provides a decreasing cross-sectional area in the combustor chamber 25 moving away from the forward end 24. The second segment 36 includes the increasing distance 42 between the inner wall 30 and the outer wall 28. The increasing distance 42 generally results in an increasing cross-sectional area moving toward the aft end 26.

The reduction in transverse span within the first segment 34 provides a desirable arrangement for fuel and air mixing. Further, the convergent configuration of the first segment 34 in combination with the divergent configuration of the second segment 36 decreases residence time for the fuel-air mixture within the combustor chamber 25. The decrease in residence time of the fuel-air mixture within the combustor chamber 25 generally decreases the formation of undesirable emissions from the combustion process by the combustor assembly 14.

The transition segment 38 includes a constant distance 44. The distance 44 is specifically less than the distance 40 within the first segment 34 to minimize mixing scales or the transverse distance across which air addition through apertures proximate to the transition segment 38 mix to the betterment of mixing efficiency. The transition segment 38 is shown in FIG. 1 as a plane between the first segment 34 and the second segment 36. The transition segment 38 is disposed at a distance 45 from the aft open end 26. The distance 45 provides a desired position that encourages desired mixing of fuel and air within the forward and aft segments 34, 36 of the combustor assembly 14.

Figure 2:
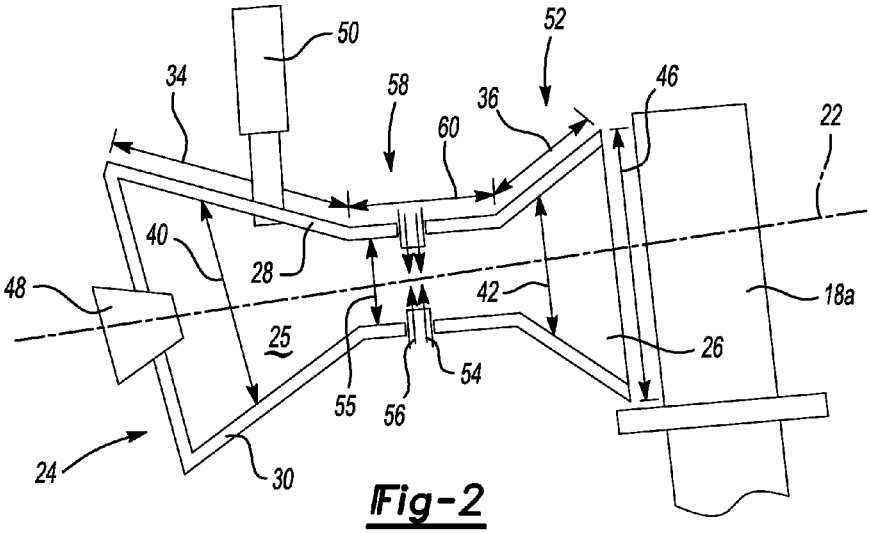
FIG. 2 is a schematic illustration of another combustor assembly according to this invention.

Referring to FIG. 2, another example combustor 52 according to this invention is shown and includes a transition segment 58 having a length 60. The transition segment 58 includes the distance 55 between the inner wall 30 and the outer wall 28. The distance 58 is substantially constant throughout the transition segment 58.

The transition segment 58 includes openings 54 for the introduction of process air through an aperture 56. The aperture 56 introduces air into the transition segment 58 to aid combustion of fuel. The substantially parallel orientation of the outer wall 28 and the inner wall 30 provided by the constant distance 55 between the inner and outer walls 28,30 in the transition segment 58 coupled with geometry of the aperture 56 and air flow magnitude, control the introduction of process air into the combustion chamber 25. The parallel orientation of the inner wall 30 to the outer wall 28 also provides desired control of the mixing volume of fuel and air utilized to control the temperature and flow quality, profile and distribution that is provide to the downstream turbine vane 18A.

Figure 3:
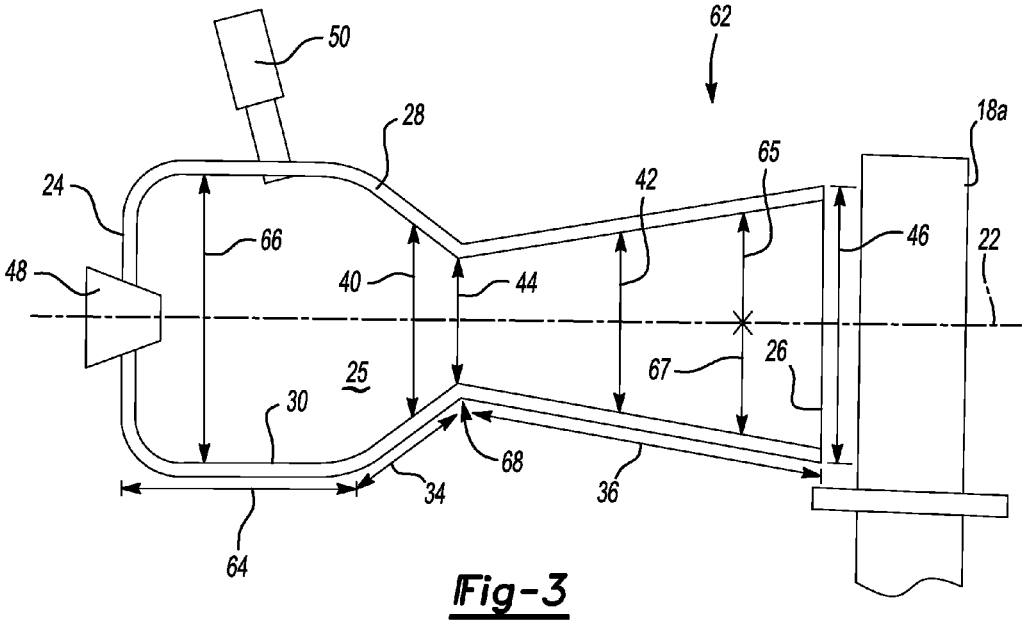
FIG. 3 is a schematic illustration of yet another combustor assembly according to this invention.

Referring to FIG. 3, another example combustion assembly 62 is shown that includes a transition segment 68 that is a plane in cross-section. The combustor assembly 62 also includes the aft segment 36 that includes a distance 42 that provides an increasing cross-sectional area. The example combustor assembly 62 includes the first segment 34 that is adjacent the forward end 24 that includes a constant cross-section region 66 having a length 64. The constant cross-section region 66 includes a constant distance 66. The constant distance 66 transitions into the convergent portion of the first segment 34 with a decreasing distance 40 transverse to the axis 22 toward the aft end 26. The partial parallel walled segment adjacent the forward end 24 provides a desired mixing chamber configuration to control mixing and combustion and that may be suitable to ease hardware fabrication and packaging.

The second segment 36 diverges toward the open aft end 26 such that the distance 42 transverse to the axis 22 produces an increasing cross-section in a direction along the axis 22 toward the aft end 26. The second segment 36 is not symmetrical about the axis 22. That is the distance 42 includes a first portion 65 between the axis 22 and the outer wall 28 and a second portion 67 between the axis 22 and the inner wall 30 that is not equal to the first portion 65. Accordingly, the angle of the inner wall 30 relative to the outer wall 28 is different. The different distance from the axis 22 provides for the divergent second segment 36 to match up against the desired exit span 46 of the turbine vanes 18A.

Figure 4:
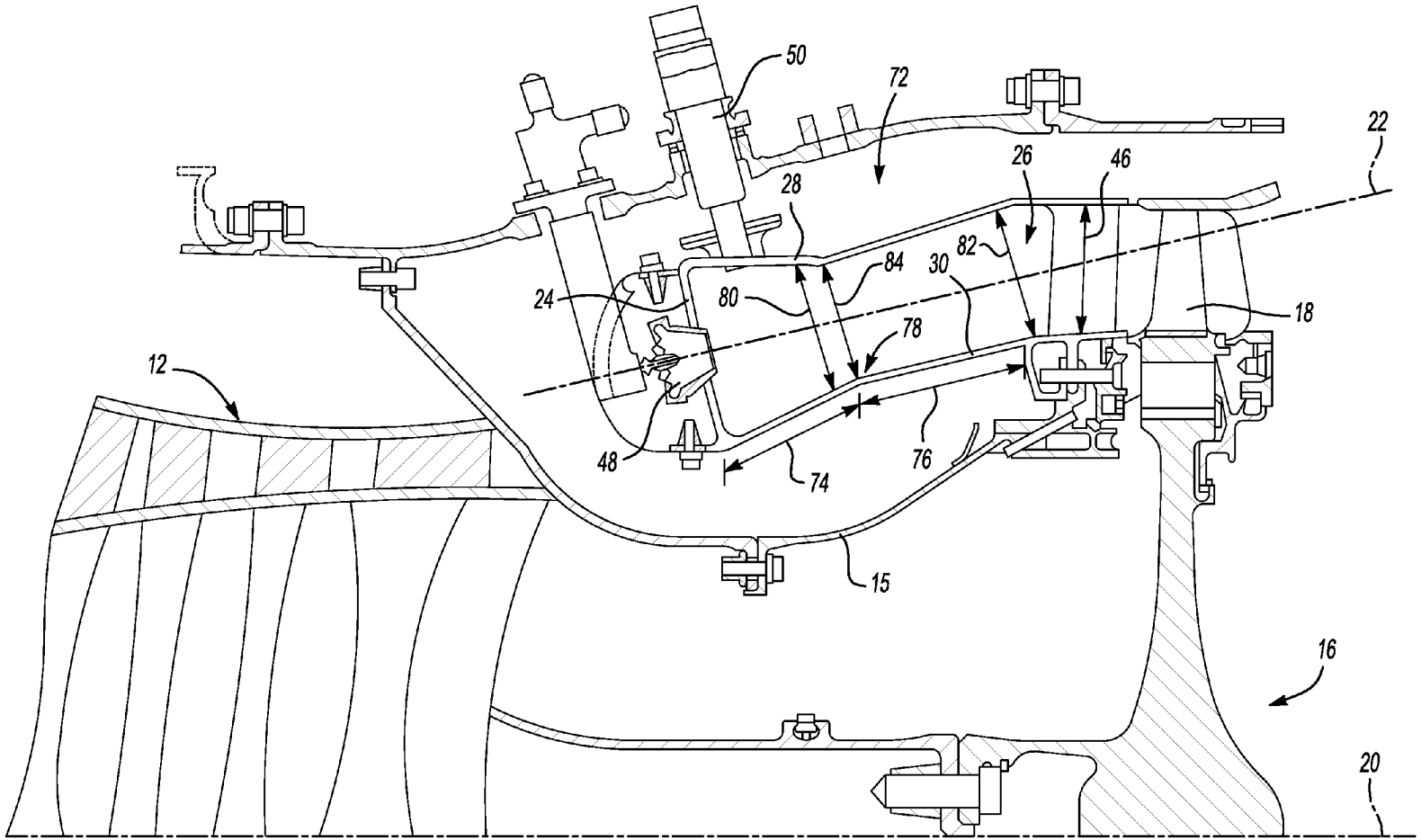
FIG. 4 is a cross-cross section of another gas turbine engine including an example combustor assembly according to this invention.

Referring to FIG. 4, another combustor assembly 72 according to this invention includes a first segment 74 that converges toward a transition plane 78, and then diverges in a second segment 76 toward the open end 26 and exit span 46. The first segment 74 includes a decreasing distance 80 that is transverse to the axis 22 in a direction toward the transition plane 78, from the forward end 24. The second segment 76 begins from the transition plane 78 and diverges in a direction toward the aft end 26. The first segment 74 includes a distance 80 that decreases toward the transition segment to a distance 84. From the transition segment 78 the distance between the inner wall 30 and the outer wall 28 increases to the aft open end 26.

The convergent-divergent arrangement of the combustor provides design flexibility to reduce emissions without sacrificing other elements of the design intent. The convergent/divergent arrangement provided for in example combustors designed according to this invention reduces residence times in the combustor and also preserves the desired proximity between the inner and outer combustor walls in one region for mixing of dilution air with combustion products at the front end of the combustor chamber 25. Both result in desired control over the combustion process and provide for designs that produce desirably low emissions. The flaring of the liners downstream of the dilution region provided by the transition segment is also advantageous to cooling, durability and control of the temperature profile into the downstream turbine.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A combustor assembly comprising:

a first liner wall and a second liner wall defining a combustion chamber, wherein the combustion chamber is defined about an axis and includes a forward end and an aft opening;

a first segment where the first liner wall and the second liner wall converge toward each other to define a decreasing cross-sectional area in a direction away from the forward end;

a second segment where the first liner wall and the second liner wall diverge to define an increasing cross-sectional area in a direction toward the aft opening that defines a terminal end of the combustor assembly and a beginning of a turbine assembly; and a transition segment between the first and second segments including a constant cross-sectional area, wherein the second segment defines an increasing cross-sectional area along the axis that increases from the transition segment entirely to the aft opening.

2. The assembly as recited in claim 1, wherein the transition segment comprises an axial length between the first segment and the second segment.

3. The assembly as recited in claim 1, including an opening for introducing air into the combustion chamber disposed within the transition segment.

4. The assembly as recited in claim 1, including a fuel nozzle disposed within the first segment.

5. The assembly as recited in claim 1, wherein the combustor assembly is annular and the first liner wall defines an outer most radial portion of the combustor assembly and the second liner wall defines an inner most radial portion of the combustor assembly.

6. The assembly as recited in claim 1, wherein the first liner wall and the second liner wall are symmetric about a combustor axis, and said cross-sectional area is defined transverse to the combustor axis.

7. The assembly as recited in claim 1, wherein the first liner wall and the second liner wall are non-symmetric about a combustor axis, and the cross-sectional area is transverse to the combustor axis.

8. A gas turbine engine assembly comprising:

a compressor;

a turbine assembly including a plurality of turbine vanes; and a combustor assembly including a first segment where a first liner wall and a second liner wall are defined about an axis and converge toward each other to define a decreasing cross-sectional area in a direction away from a forward end, a second segment where the first liner wall and the second liner wall diverge to define an increasing cross-sectional area in a direction toward an aft open end that defines a terminal end of the combustor assembly and a beginning of the turbine assembly, and a transition segment having a constant cross-sectional area, wherein the aft end includes a cross-sectional area corresponding to an exit span of the plurality of turbine vanes, wherein the second segment defines an increasing cross-sectional area along the axis that increases from the transition segment entirely to the aft opening.

9. The assembly as recited in claim 8, wherein the transition region includes an axial length and an air introduction opening is disposed within the width.

10. The assembly as recited in claim 8, wherein the combustor assembly is annular and includes a combustor axis.

11. The assembly as recited in claim 8, wherein the cross-sectional area within the first segment and the second segment are transverse to the combustor axis.

12. The assembly as recited in claim 8, wherein the first liner wall and the second liner wall are non-symmetric about a combustor axis and the cross-sectional area is transverse to the combustor axis.

13. A method of reducing undesirable combustor emissions from a gas turbine engine comprising the steps of:

introducing fuel and air into a first segment of a combustor chamber defined about an axis, reducing a residence time for fuel and air within the first segment by reducing a volume of the first segment in an axial direction toward an aft opening of the combustor that defines a terminal end of the combustor and a beginning of a turbine section;

controlling temperature gas flow characteristics within a second segment by increasing a volume of the second segment in an axial direction toward the aft opening of the combustor; and providing a transition region between the first segment and the second segment, wherein the transition region includes a minimum cross-sectional area of the combustion chamber and the second segment includes an increasing volume along the axis that increases from the transition segment entirely to the aft opening.

14. The method as recited in claim 13, including the step of providing spatial mixing of fuel and air within the transition region by introducing process air into the combustion chamber within the transition region.

* * * * *